United States Patent [19]

Hera

[11] Patent Number: 4,528,721

[45] Date of Patent: Jul. 16, 1985

[54] TRANSPORT SYSTEM FOR SPINNING PREPARATION

[75] Inventor: Georg Hera, Dietlikon, Switzerland

[73] Assignee: Rieter Machine Works Ltd., Winterthur, Switzerland

[21] Appl. No.: 581,782

[22] Filed: Feb. 21, 1984

[30] Foreign Application Priority Data

Mar. 2, 1983 [CH] Switzerland ..... 1139/83

[51] Int. Cl.[3] ..... D01B 3/04

[52] U.S. Cl. ..... 19/65 R; 19/115 R; 19/236; 57/276; 57/281

[58] Field of Search ..... 19/65 R, 115 R, 236; 57/276, 281

[56] References Cited

U.S. PATENT DOCUMENTS

| | | | |
|---|---|---|---|
| 3,013,313 | 12/1961 | Catling et al. | 19/236 X |
| 3,040,916 | 6/1962 | Preston | 414/381 |
| 3,388,432 | 6/1968 | Saikawa et al. | 19/65 R |
| 3,440,688 | 4/1969 | Yamamoto et al. | 19/115 X |
| 3,904,050 | 9/1975 | Kimura et al. | 19/65 R |

FOREIGN PATENT DOCUMENTS

| | | |
|---|---|---|
| 527346 | 4/1954 | Belgium . |
| 1288490 | 1/1969 | Fed. Rep. of Germany . |
| 1227796 | 3/1960 | France . |
| 840654 | 7/1960 | United Kingdom . |

*Primary Examiner*—Louis K. Rimrodt

*Attorney, Agent, or Firm*—Werner W. Kleeman

[57] ABSTRACT

A transport system for transporting laps wound on tubes in spinning preparation. The laps are transported above head height by carriers or supports movable along transport rails and are raised and lowered by means of carrier rails. The transport rails and the carrier rails are components or parts of a closed, endless circulation path or track. Each carrier has a holder for the lap and a holder for the empty tube. The invention provides the advantages that no special transport system is required for return of the tubes. Moreover, transport of individual laps or of a group of such laps is possible and an ordered and simple circulation path is provided during transport of these elements or parts. Furthermore, the system can readily be automated.

10 Claims, 3 Drawing Figures

11
12
12
13
13
13
13
13
13a
14
14
16
17
18
19
20
21
23
24
26
26
26
30
II
II

TRANSPORT SYSTEM FOR SPINNING PREPARATION

BACKGROUND OF THE INVENTION

The present invention relates to a new and improved transport system or installation for use in spinning preparation for transporting laps from a first machine to a second machine by means of carriers or supports which are movable along transport rails located above head height, the laps carried by the transport rails being located at a greater height above the ground than the laps deposited at the lap transfer locations of the machines, and a carrier rail movable in the vertical direction being provided for the carriers at each lap transfer location.

From German Published Pat. No. 1,288,490, published Jan. 30, 1969 a system is known in which lap carriers travel along an endless transport path at a predetermined mutual spacing from one another. The laps to be transferred to the lap carriers are lifted and grasped by the continually moving lap carriers. The laps can only be transferred individually and transported at the same mutual spacing. This system does not permit simultaneous delivery of a group of laps. Return of empty bobbin tubes by the transport system is also not possible. Rather, the empty bobbin tubes must be returned by a special transport system.

German Utility Model No. 7,424,750 relates to a device which also has an endless transport belt for automatic transport of laps. In this case, the lap carriers and empty package carriers which are separate from the lap carriers travel along the transport belt. In this device also a plurality of laps cannot be delivered simultaneously nor can a plurality of bobbin tubes be carried away simultaneously.

Japanese Patent Specification No. 47-46852 teaches a system in which a plurality of lap carriers are passed simultaneously to a transport rail by means of a carrier rail. This transport rail does not form a closed circulation path, so that the lap carriers must be returned along the same path on which they were delivered to a machine. Thus, freedom in transporting the carriers is reduced. Also, the carriers have no means or facility serving for return of empty bobbin tubes. Accordingly, with this transport system or installation also special means serving for the latter purpose must be provided.

SUMMARY OF THE INVENTION

Therefore, with the foregoing in mind it is a primary object of the present invention to provide an improved transport system for spinning preparation which is not afflicted with the aforementioned drawbacks and limitations of the prior art.

Still a further significant object of the present invention is to provide an improved transport system for spinning preparation which enables transport of both the lap and also the empty bobbin tube along an orderly and simple circulation path or track.

Another important object of the present invention is to provide an improved transport system of the character described which is relatively simple in construction and design, quite economical to manufacture, highly reliable and versatile in operation, not readily subject to breakdown and malfunction, and requires a minimum of maintenance and servicing.

Now in order to implement these and still further objects of the invention, which will become more readily apparent as the description proceeds, the inventive transport system for use in spinning preparation is manifested by the features that, the transport rails and the carrier rails brought to the height of the transport rails form components or parts of a closed, endless circulation path or track and each carrier has a holder for the lap and a holder for the empty bobbin tube. The invention thus permits transport of both the lap and also the empty bobbin tube along an ordered and simple circulation path or track.

BRIEF DESCRIPTION OF THE DRAWINGS

The invention will be better understood and objects other than those set forth above, will become apparent when consideration is given to the following detailed description thereof. Such description makes reference to the annexed drawings where throughout the various figures of the drawings there have been conveniently used the same reference characters to denote the same or analogous components or parts and wherein.

DETAILED DESCRIPTION OF THE PREFERRED EMBODIMENTS

Figure 1:
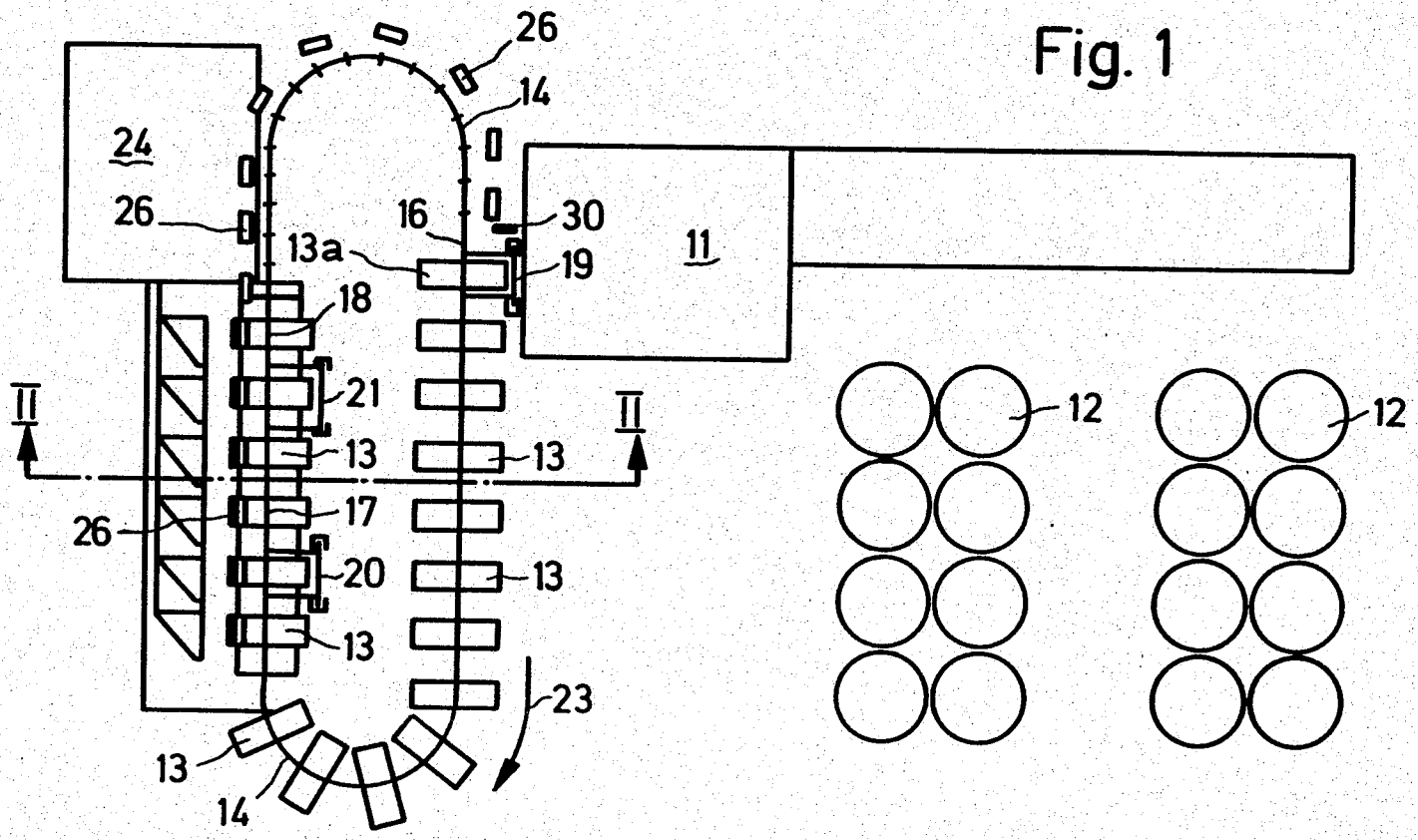
FIG. 1 shows a schematic representation, viewed from above, of a transport system arranged between a sliver lap machine and a ribbon lap machine.

Describing now the drawings, it will be understood that it order to simplify the illustration thereof only enough of the details of the transport system and related structure have been shown as needed for those skilled in the art to readily understand the underlying principles and concepts of the present invention. In accordance with the showing of FIGS. 1 and 2 there is provided a sliver lap machine 11 to which non-illustrated fiber slivers are fed from sliver cans 12 or the like. In the sliver lap machine 11 the fiber slivers are combined to form a sheet or web and laps 13 are formed from the latter. One of the laps, such as the lap 13*a*, is shown located at a lap transfer location 43 at the sliver lap machine 11. Transport rails 14 are part of a closed, endless circulation path or track for carriers or supports 15 which are movable along this circulation path or track. The carriers 15 serve for carrying and transporting the laps 13 and empty or bare bobbin tubes 26. During such transport, they move in the direction indicated by the arrow 23.

A carrier or support rail 16 and carrier or support rails 17, 18, which are movable in a substantially vertical direction, also form components or parts of the circulation path or track. In this embodiment the latter is constituted by the transport rails 14 and the carrier rails 16, 17, 18. The carrier rail 16 is vertically movable up and down between a position which it adopts for grasping of a lap 13*a* located at the lap transfer location 43 and the height of the transport rails 14. In FIG. 2, the lap 13*a* is located at the lap transfer location 43 in a position in which it is grasped by the carrier or support 15, and the carrier rail 16 is located at its height or position appropriate for such grasping of the lap 13*a*. In FIG. 2, the carrier rail 18 is also located in its lowered position relative to the height of the transport rails 14, in which position three laps 13 deposited from the carrier rail 18 are laid upon the lap transfer location 80 of the ribbon lap machine 24. Vertical movements of the carrier rails 16, 17 and 18 are caused by the lifting or displacement devices 19, 20 and 21 illustrated schematically in FIG. 1. Each of the carrier rails 17, 18 is designed for taking-up, for instance, three laps 13. These laps 13 are deposited in groups of three from the carrier rails 17, 18 on corresponding lap transfer locations.

The laps 13 are wound-up on respective tubes 26*a*. Each carrier or support 15 comprises a holder or holder member 25 for a lap 13. Each such holder 25 comprises, in the illustrated exemplary embodiment, a clamp 25*a* with clamping elements 25*b* movable relative to each other and which extend into the wound tube 26*a* from both end faces thereof in order to grasp a lap 13. The carrier or support 15 also comprises a holder 28 for the empty tubes 26. This holder 28 comprises, in the illustrated exemplary embodiment, a bar or rod 28*a* which extends radially away from the position at which it is mounted or fastened and which is joined with a bar or rod portion 29 extending at an angle thereto. Bar portion 29 extends rearwardly with reference to the transport direction of the carrier 15 and its rearward end forms a free end. The empty tubes 26 to be transported are placed or pushed onto the bar or rod portions 29. A stop or abutment 30 fixed with reference to the transport system serves for taking off the tube 26 from bar portion 29. Each carrier 15 is supported by rollers 27 and is conveyable by means of these rollers 27 along the transport rails 14 and the carrier rails 16, 17, 18.

The transport rails 14 are mounted on a frame 31. They are located above head height. For clarity of illustration, the carriers or supports 15 with the holders or holder members 25 and 28 are not shown in FIG. 1. On the other hand, for the same reason, the lifting devices 19, 20 and 21 are not shown in FIG. 2.

In operation of the transport system or installation, a lap 13 or 13*a* at the lap transfer location 43 of the sliver lap machine 11 is brought to the circulation path or track upon each forward movement of the carriers 15 by one step. For this purpose, the carrier rail 16 together with the carrier 15 located thereon is lowered by means of the related lifting device 19, the lap 13*a* located at the lap transfer location 43 is grasped by means of the holder 25 of the carrier 15 and the carrier rail 16 is lifted again by means of the lifting device 19 to the height at which the carrier rail 16 is now aligned with the transport rail 14.

With the carrier or support rail 16 raised, the carrier or support 15 located thereon together with the lap 13 or 13*a* carried thereby is moved further stepwise by any suitable and therefore not particularly illustrated means along the transport rail 14 in the direction of the arrow 23.

By means of the lifting devices 20 and 21 respective groups of three laps 13 are deposited simultaneously at the ribbon lap machine 24. The lowering of these lap groups is carried out alternately. If three laps 13 are required at the lap transfer location 80 associated with the carrier rail 17, then three laps 13 are brought to the carrier rail 17. Then, the latter is lowered and thereafter three tubes 26 released at the ribbon lap machine 24 from delivered laps 13, are donned on the tube holders 28 or bar portions 29 of the three carriers 15 located on the carrier rail 17. Thereafter, the laps 13 are deposited upon the lap transfer location 80 and released. Finally, the carrier rail 17 is again lifted, so that it is aligned once again with the transport rail 14 and the carrier rail 18 to close the previously formed interruption or gap formed therebetween. Thus, the circulation path or track is again closed. When the three laps 13 located on the carrier rail 18 are required, delivery is effected in a procedure which corresponds to that just described with reference to the carrier rail 17. Accordingly, there would not appear to be any necessity for any further detailed description thereof.

After the six laps 13 located at the lap transfer location 80 of the ribbon lap machine 24 have been transferred, and after six empty tubes 26 have been donned and the carrier rails 17, 18 raised again, the carriers 15 are moved further through six steps and six new laps 13 are brought to the ribbon lap machine 24.

The tubes 26 donned onto the holders 28 or bar portions 29 and arriving at the sliver lap machine 11 strike or impact against the stop or abutment 30. They are thus pushed off the bar portions 29. These stripped tubes 26 pass into a receiver 22 and are thereafter ready for reuse for new laps 13.

It is clear that as a result of the closed circulation path or track formed by the transport rails 14 and carrier rails 16, 17 and 18 a simple and thus trouble-free transport of laps 13 and tubes 26 is obtained. This transport arrangement for the laps and tubes can be operated manually to any required extent as desired, or can be automated to a more or less high degree.

The carrier rail 16 is designed for lifting of individual laps 13. In a non-illustrated, modified embodiment a carrier rail serving for simultaneous lifting of a plurality of, for example three, laps is provided. According to a further, modified embodiment, the tube holder can comprise a trough in place of the illustrated bar-shaped embodiment; the empty tubes 26 can be laid in the trough. Also in this case, with the trough arranged essentially parallel to the direction of movement of the carriers, the tubes 26 are pushed out of the trough by a stop 30.

The sliver lap machine 11 delivers the fiber sheet in the form of an endless band. When the lap is full the band must be cut. In an especially advantageous embodiment, the carriers 15 are provided with a holder rod 32 which is biased towards the lap 13 (or 13*a*). The holder rod 32 is arranged at right angles to the plane of the drawing in FIG. 2. It is carried at each end by an arm 33. These arms 33 are pivotable about an axis or shaft 34 disposed at right angles to the plane of the drawing in FIG. 2. The bias or loading of the holder rod 33 can be produced for example by a non-illustrated spiral spring or the like wound about the axis or shaft 34.

Through the cutting of the band required for the transport of the lap 13 there arises an outer free end 35 on the sheet. The holder rod 32 engaging the lap 13 or 13*a* holds this end 35 of the sheet, so that the lap 13 can be transported in a trouble-free manner without a loose, dangling portion.

In the illustration of FIG. 2, during grasping of the lap 13*a* at the sliver lap machine 11, the attendant or operator is located to the left of the lap 13*a* and can, by pivoting the holder rod 32 about the axis 34, easily draw the end 35 of the sheet between the holder rod 32 and the lap 13*a*. When the laps 13 have arrived at the ribbon lap machine 24, then the ends 35 of the sheets are located in accordance with FIG. 2 on the left-hand side of the laps 13. This is the side on which the attendant or operator is located. Thus, at this machine the end 35 of the sheet is especially easily accessible and can be fed in a simple manner into the ribbon lap machine 24 for further processing. The lap 13 also comes to rest in such a manner that the sheet is drawn therefrom in the correct rotational sense. It is clear that the construction of the transport system is carried out in such a manner that the end 35 of the sheet and the holder rod 32 are located at both machines 11 and 24 on the side on which the end of the sheet is subjected to manipulation. The advantageous positioning of the lap 13 at both lap transfer locations 43 and 80 is effected by the change of the direction of the transport rail 14 through 180°, that is by virtue of the described construction of the transport system.

Figure 3:
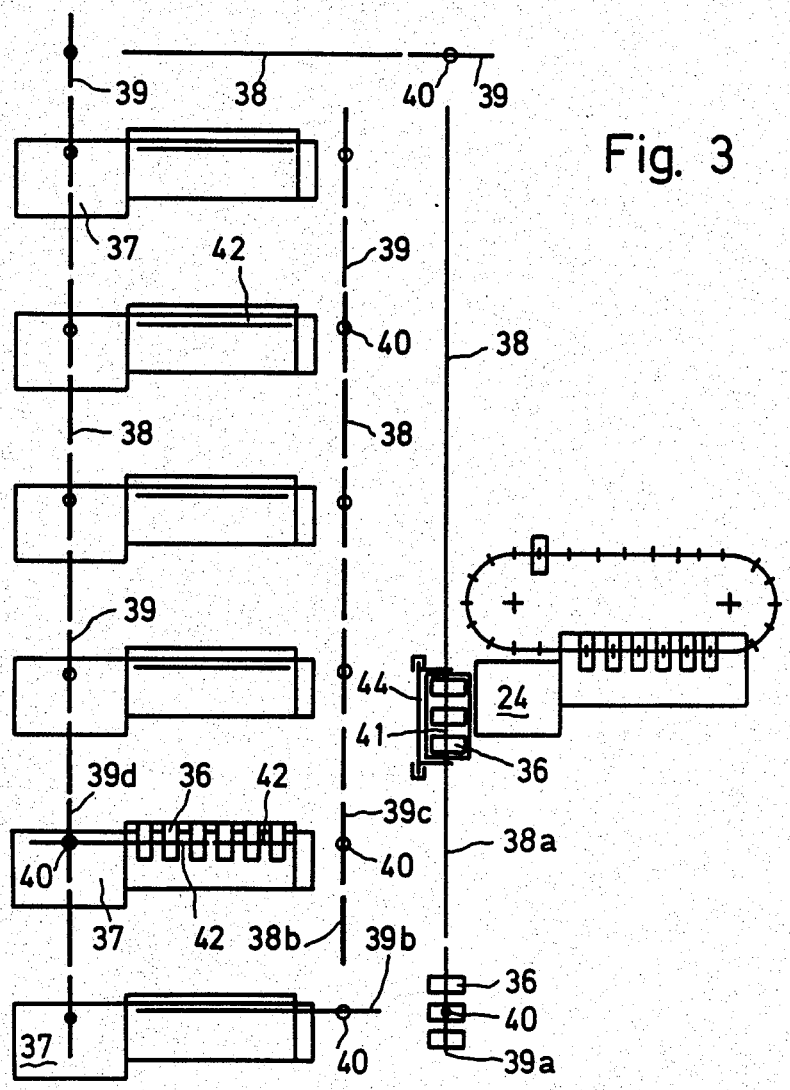
FIG. 3 shows a schematic representation, viewed from above, of a transport system located between a ribbon lap machine and a combing machine.

In FIG. 3 a further embodiment of a transport system or installation according to the invention is shown. This transport system relates to the transport of laps 36 from a ribbon lap machine 24 to combing machines 37. Once again there are provided transport rails 38*a*, 38*b*, generally indicated by 38, for the transport of laps 36 and of empty tubes. Further, at the ribbon lap machine 24 there is a carrier or support rail 41 movable vertically up and down, and at the combing machines 37 there are carrier or support rails 42 movable vertically up and down. The transport rails 38 do not have bend portions effecting the change of direction of the circulation path or track. Instead, rail portions 39*a*, 39*b*, 39*c*, 39*d*, generally indicated by 39 are provided, each of which is pivotable about its related vertical axis 40. By means of the rail portions 39 a closed, endless circulation path or track is once again provided.

Laps 36 are lifted for transport in groups of three by means of the carrier or support rail 41. A table 44 can be provided as a lap transfer location. The three laps 36 lifted by the carrier rail 41 are brought via the transport rail 38*a* onto the rail portion 39*a*, while the latter rests in its illustrated location with its one end on the transport rail 38*a* leading from the ribbon lap machine 24. Then, the rail portion 39*a* is rotated through 90°, so that it is aligned with the rail portion 39*b*. Now, the three laps 36 are moved onto the rail portion 39*b*. If these laps 36 are intended for the lowest combing machine 37 shown in FIG. 3, then they are transported to its lap transfer location and deposited thereon.

If, however, this group of laps 36 is intended, for example, for the second lowest combing machine 37, then the rail portion 39*b* is rotated through 90° and the laps 36 are passed via the transport rail 38*b* to the rail portion 39*c*. From the location of the latter, they are fed to the second lowest combing machine 42 and deposited on the lap transfer location thereof.

Figure 2:
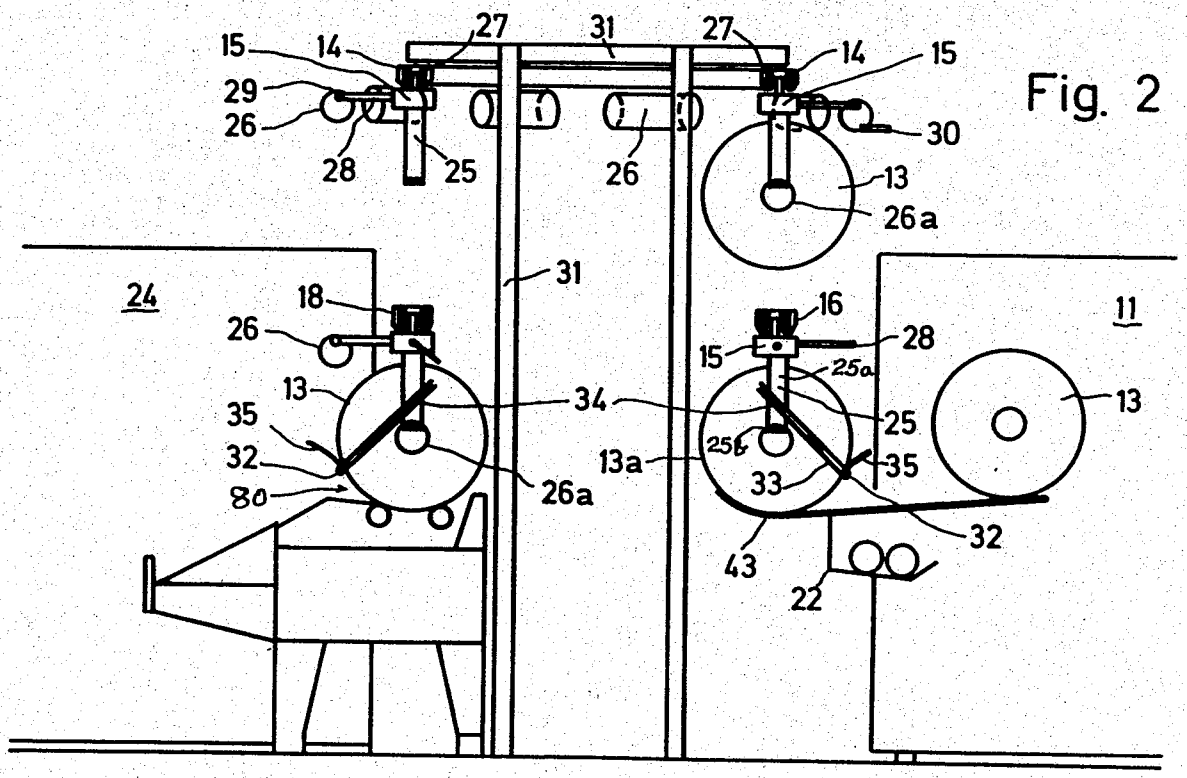
FIG. 2 shows a schematic side view taken substantially along the line II—II of FIG. 1.

It is noted with reference to the embodiments concerning the end 35 of the sheet according to FIGS. 1 and 2, that also in the embodiment according to FIG. 3 carriers or supports 15 of the type shown in FIG. 2 are used. These carriers 15 are again provided with a holder rod 32 which rests against the outermost end 35 of a lap 36 during transport thereof. It is clear that in the embodiment according to FIG. 3 through rotation of the rail portions 39 about their axes or pivots 40 in the one direction or in the opposite direction, the ends 35 of the sheets always can be brought to the required side, that is to the side on which they are subjected to a manipulation. In this embodiment this result is thus obtained by appropriate choice of the pivoting range of the rail portions, that is also through an appropriate construction of the transport system.

The return of empty tubes is effected via the transport rails 38 and rail portions 39 illustrated on the left-hand side of FIG. 3.

In the embodiment of FIG. 3 the laps 36 are delivered to the combing machines 37 in groups of three laps 41. It is clear that instead of this arrangement, there could be provided lap groups of four which are normal in practice, or also other lap group sizes. In such case, the rail portions 39, the carrier rail 41, the table 44 and the carrier rails 42 are advantageously arranged to receive respectively four carriers or an appropriate number of such carriers.

While there are shown and described present preferred embodiments of the invention, it is to be distinctly understood that the invention is not limited thereto, but may be otherwise variously embodied and practiced within the scope of the following claims.

Accordingly, what I claim is:

1. A transport system for use in spinning preparation for transporting laps from a first machine to a second machine, each said machine having at least one lap transfer location, comprising:

transport rails located above head height;

carriers which are movable along said transport rails located above head height for transporting the laps from the first machine to the second machine;

the laps carried by the transport rails being located at a greater height above ground than the laps deposited at lap transfer locations of the machines;

at least one carrier rail movable in a substantially vertical direction provided for the carriers at each lap transfer location;

means for moving said carrier rail up and down between a position appropriate for grasping of the laps at a lap transfer location and the height of the transport rails;

the transport rails and the carrier rail brought to the height thereof forming parts of a closed, endless circulation path; and a holder for the laps and a holder for empty tubes provided for each carrier.

2. The transport system according to claim 1, wherein:

each holder for the laps comprises a clamp provided with clamping elements movable relative to one another; and said clamping elements extending into a tube from both ends thereof in a transport position of the lap.

3. The transport system according to claim 1, wherein:

the first machine is a sliver lap machine and the lap transfer location thereof is provided with at least one of said carrier rails which serves for lifting at least one lap.

4. The transport system according to claim 1, wherein:

the second machine is a ribbon lap machine at the lap transfer location of which there are provided a plurality of said carrier rails for simultaneous lowering of a plurality of laps.

5. The transport system according to claim 1, wherein:

the first machine is a ribbon lap machine and the second machine is a combing machine; and at least one respective one of said carrier rails serves for lifting and lowering a plurality of laps at the lap transfer locations of each of these machines.

6. The transport system according to claim 1, wherein:

said circulation path includes an interruption having two opposed ends;

a rail portion supported for rotation about a substantially vertical axis and containing space for accommodating at least one of said carriers;

said rail portion being inserted between said two opposed ends of said interruption in the circulation path at least at one position where there occurs a change of direction of the circulation path; and the rail portion forming a part of the circulation path and adjoining in one rotational position thereof the one end of the interruption and in a second rotational position thereof the other end of the interruption.

7. The transport system according to claim 1, wherein:

the holder for the empty tubes comprises a bar portion which extends rearwardly with respect to a predetermined transport direction of the carriers; and said holder having a rearward end which forms a free end.

8. The transport system according to claim 1, further including:

a holder rod provided for each carrier; and each said holder rod being arranged substantially parallel to a tube axis of the lap carried thereby, is swingable towards and away from the lap and rests, during transport of the lap, against the lap at the outer end of a wound-up sheet of said lap.

9. The transport system according to claim 8, wherein:

the holder rod is biased towards the lap.

10. The transport system according to claim 8, wherein:

said transport system is structured such that at the machines the holder rods on the transported laps are always located on a side at which an outer end of the wound-up sheet is subjected to a manipulation.

* * * * *